US010724839B2

(12) United States Patent
Cahill

(10) Patent No.: US 10,724,839 B2
(45) Date of Patent: Jul. 28, 2020

(54) AMMUNITION HOLDING ASSEMBLY AND SYSTEM

(71) Applicant: Daniel E. Cahill, Huron, SD (US)

(72) Inventor: Daniel E. Cahill, Huron, SD (US)

( * ) Notice: Subject to any disclaimer, the term of this patent is extended or adjusted under 35 U.S.C. 154(b) by 0 days.

(21) Appl. No.: 16/242,843

(22) Filed: Jan. 8, 2019

(65) Prior Publication Data

US 2019/0310060 A1 Oct. 10, 2019

Related U.S. Application Data

(60) Provisional application No. 62/654,392, filed on Apr. 7, 2018.

(51) Int. Cl.
*F42B 39/02* (2006.01)
*A41D 27/20* (2006.01)
*A41D 1/04* (2006.01)

(52) U.S. Cl.
CPC ..... *F42B 39/02* (2013.01); *A41D 1/04* (2013.01); *A41D 27/20* (2013.01); *A41D 2600/108* (2013.01)

(58) Field of Classification Search
CPC ..... F42B 39/02; F42B 39/08; F42B 39/26; Y10S 224/931; Y10S 2/92
See application file for complete search history.

(56) References Cited

U.S. PATENT DOCUMENTS 3,337,101 A 8/1967 Tombari
3,777,954 A * 12/1973 Theodore ..... F42B 39/02 224/199
4,303,239 A * 12/1981 Walsh, Jr. ..... A63B 21/0603 482/105
4,613,068 A * 9/1986 Bianchi ..... F42B 39/02 224/242
4,819,846 A * 4/1989 Hannemann ..... A45F 5/00 2/312
4,843,649 A 7/1989 Jewell
5,014,359 A 5/1991 Hanson
5,127,565 A 7/1992 Grant
5,370,288 A * 12/1994 Field ..... A45C 13/02 211/60.1
5,673,836 A 10/1997 Bush
5,991,925 A * 11/1999 Wu ..... A41D 13/0012 2/102
6,176,407 B1 * 1/2001 Jones ..... F42B 39/02 224/223
6,182,291 B1 2/2001 Garvey
6,345,744 B1 2/2002 Eldridge
6,886,726 B1 5/2005 O'Hare
7,100,810 B1 * 9/2006 Bosch ..... F42B 39/02 224/196
7,559,445 B1 * 7/2009 Kulp ..... A45F 3/14 224/627
10,455,869 B1 * 10/2019 Dille ..... F42B 39/02
(Continued)

*Primary Examiner* — Brian D Nash

(57) ABSTRACT

A ammunition holding assembly and system includes a panel that has a front side, a back side and a perimeter edge. The panel is comprised of a flexible material. A plurality of receivers is positioned on the front side of the panel and each of the receivers is comprised to hold a single unit of ammunition to define a stored unit. A coupler includes a first mating member and a second mating member releasably coupled to each other. The first mating member is positioned on the back side of the panel.

16 Claims, 4 Drawing Sheets

(56) References Cited

U.S. PATENT DOCUMENTS

| | | | | |
|---|---|---|---|---|
| 2004/0245304 | A1* | 12/2004 | Cragg | A45F 3/08 224/648 |
| 2005/0188450 | A1 | 9/2005 | Clark | |
| 2008/0067203 | A1 | 3/2008 | Culhane | |
| 2008/0185413 | A1* | 8/2008 | Marques | A45F 5/02 224/674 |
| 2008/0277436 | A1* | 11/2008 | Wilson | F42B 39/02 224/239 |
| 2010/0096426 | A1* | 4/2010 | Tarnawiecki | A45F 5/00 224/666 |
| 2013/0094784 | A1* | 4/2013 | Musto, Jr. | F42B 39/02 383/39 |
| 2013/0334073 | A1* | 12/2013 | Frye | F42B 39/00 206/38 |

* cited by examiner

AMMUNITION HOLDING ASSEMBLY AND SYSTEM

CROSS-REFERENCE TO RELATED APPLICATIONS

This application takes benefit of U.S. Provisional Application 62/654,392 filed on Apr. 7, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shotgun shell storage devices and more particularly pertains to a new shotgun shell storage device for storing and allowing for selectively placement of ammunition within a body of an article of clothing to be worn while hunting.

BRIEF SUMMARY OF THE INVENTION

An embodiment of the disclosure meets the needs presented above by generally comprising a panel that has a front side, a back side and a perimeter edge. The panel is comprised of a flexible material. A plurality of receivers is positioned on the front side of the panel and each of the receivers is comprised to hold a single unit of ammunition to define a stored unit. A coupler includes a first mating member and a second mating member releasably coupled to each other. The first mating member is positioned on the back side of the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
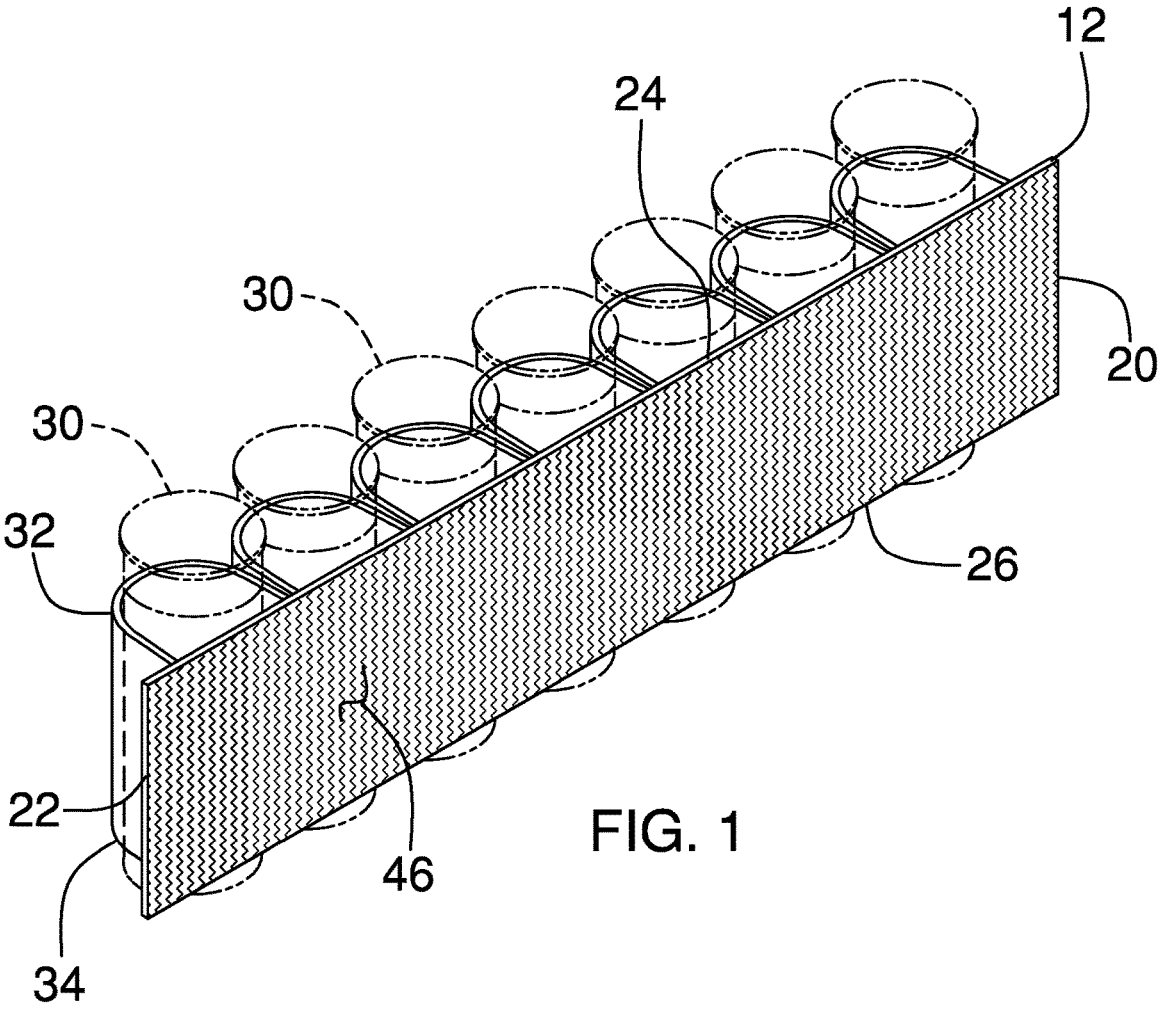
FIG. 1 is a rear isometric view of an ammunition holding assembly and system according to an embodiment of the disclosure.

With reference now to the drawings, and in particular to FIGS. 1 through 5 thereof, a new shotgun shell storage device embodying the principles and concepts of an embodiment of the disclosure and generally designated by the reference numeral 10 will be described.

As best illustrated in FIGS. 1 through 5, the ammunition holding assembly and system 10 generally comprises a panel 12 that has a front side 14, a back side 16 and a perimeter edge 18. The panel 12 is comprised of a flexible material which may include any conventional type of material used within the clothing industry such as, for example, canvas, synthetic plastics, cotton, leather, elastomer and the like. The panel 12 may have a length from a first lateral edge 20 to a second lateral edge 22 between 6.0 inches and 12.0 inches and height from a bottom edge 24 to a top edge 26 between 1.0 inches and 3.0 inches. It should be understood that the directions described herein are for illustrative purposes only as the panel 12 may be orientated in any direction required.

A plurality of receivers 28 is positioned on the front side 14 of the panel 12. Each of the receivers 28 is comprised to hold a single unit of ammunition 30 to define a stored unit. The ammunition 30 to be stored will typically include shotgun shells, however, there is no particular limitation to the type of ammunition 30 that may be utilized with the system 10 and therefore any cartridge may be used with the system 10 as long as the system 10 is fitted properly for the size of cartridge to be stored. Each of the receivers 28 has an upper end 32 and a lower end 34 each being open such that the stored unit of ammunition 30 extends outwardly of the upper 32 and lower 34 ends. A height of each receiver 28 will typically be greater than 0.75 inches and less than 3.0 inches. The receivers 28 are aligned laterally along the front side 14 of the panel from the first lateral edge 20 to the second lateral edge 22. The number of receivers 28 may vary but will typically include at least four receivers 28 and less than twelve receivers 28.

Figure 2:
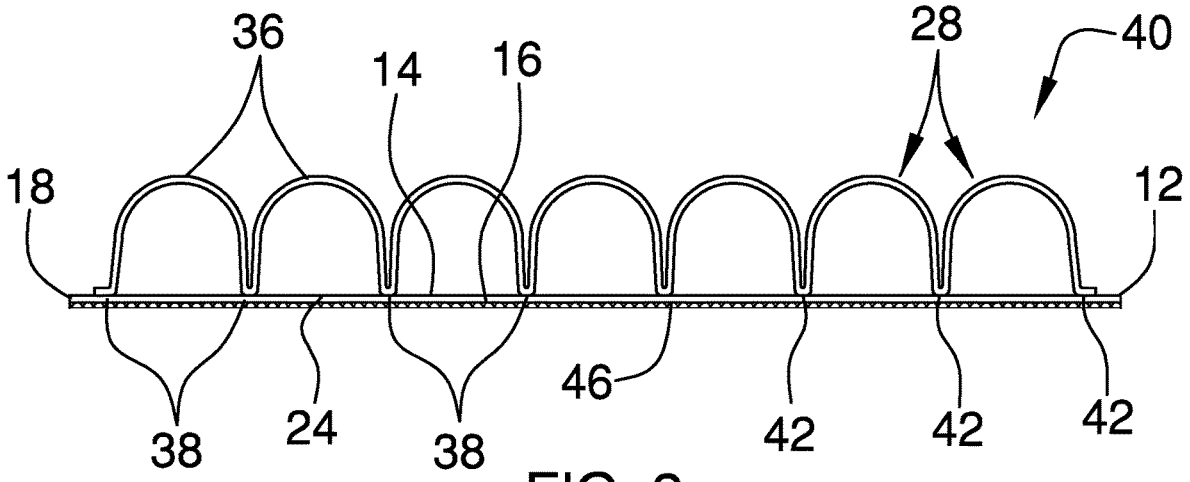
FIG. 2 is a top view of an embodiment of the disclosure.

Each of the receivers 28 comprises a resiliently elastic material to allow their expansion while being filled with ammunition 10 and to tighten against, and secure in place, the ammunition 10. Any type of elastomeric cloth or material may be utilized as well as elastomers, plastics and the like having the required property of being sufficiently stretchable while also being resiliently so. More particularly, each of the receivers 28 comprises an arcuate outer wall 36 extending away from the front side 14 and each arcuate outer wall 36 has a pair of ends 38 attached to front side 14. Each the outer wall 36 and an associated section of the front side 14 defines a tubular member for receiving the ammunition 10. As can be seen in FIG. 2, in particular, the outer wall 36 may be formed by an elongated piece 40 of stretchable material that is secured to the front side at attachment points 42 positioned at even lengths along the elongated piece 40 to form the receivers. The attachment points 42 may be formed by any conventional manner such as stitching or bonding together of the panel and the elongated piece 40.

A coupler 44 is provided that includes a first mating member 46 and a second mating member 48 releasably coupled to each other. The first mating member 46 is positioned on the back side 16 of the panel 12. The coupler 44 may, in particular, comprise a hook and loop coupler. Such hook and loop couplers are ubiquitously referred to under the trademark Velcro though any structure containing essentially same structure may be utilized for the purposes herein.

An article of clothing is also provided and is configured to be worn on a torso of a person. The article of clothing may include specifically those types of articles which are used during hunting such as jackets or vest jackets 50. Such jackets typically include one or more pockets 52 having an interior surface 54. More particularly, hunting vest jackets 50 often include a very large pocket 52 that extends from a front side of the vest jacket 50 to a rear side thereof and is used for holding small game such as pheasants, gross, dove and the like. When the game is placed in such pockets 52, it moves toward the bottom and back of the vest jacket 50 as to not interfere with the movement of the wearer thereof.

Figure 3:
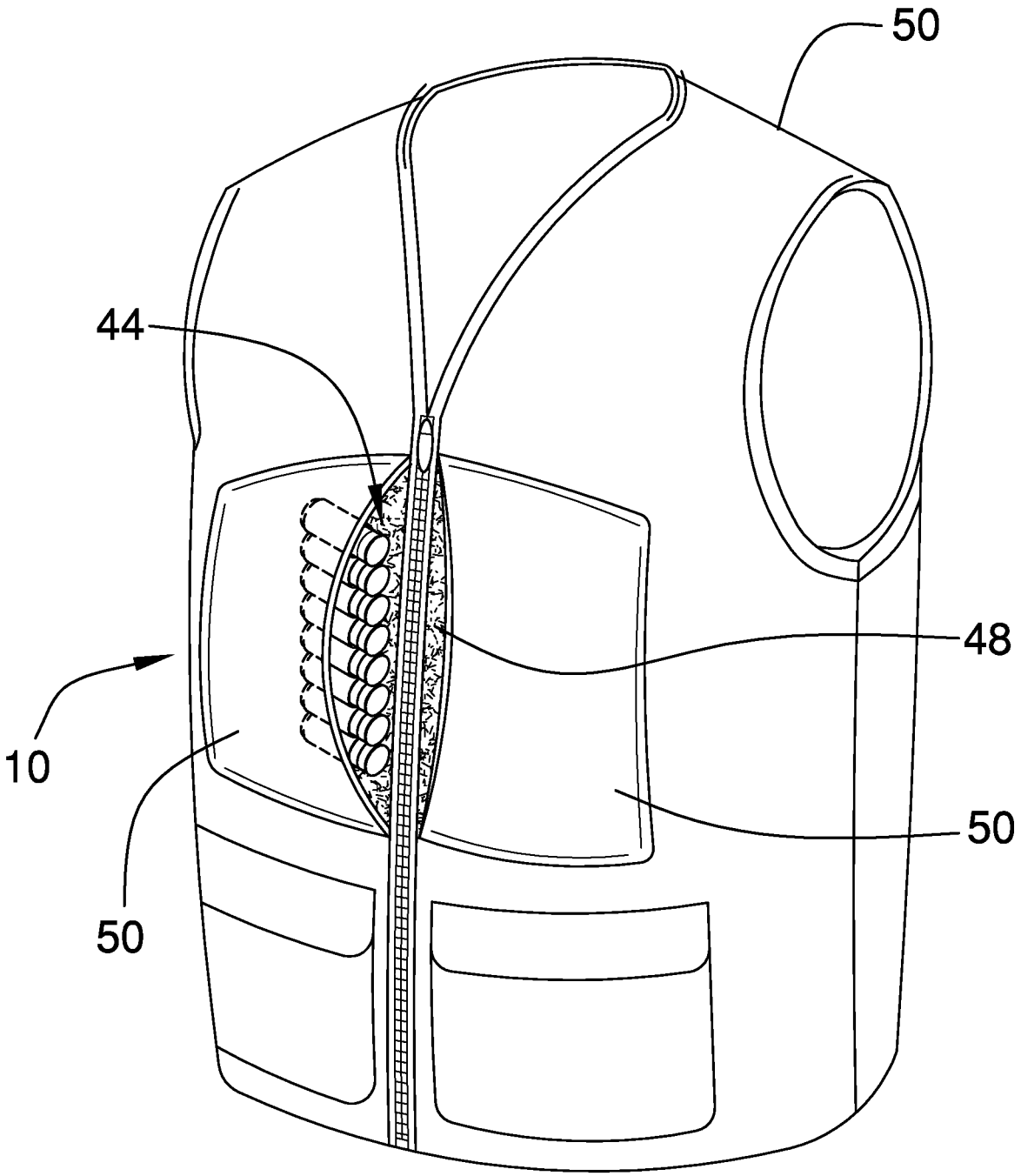
FIG. 3 is a front isometric view of an embodiment of the disclosure.
Figure 4:
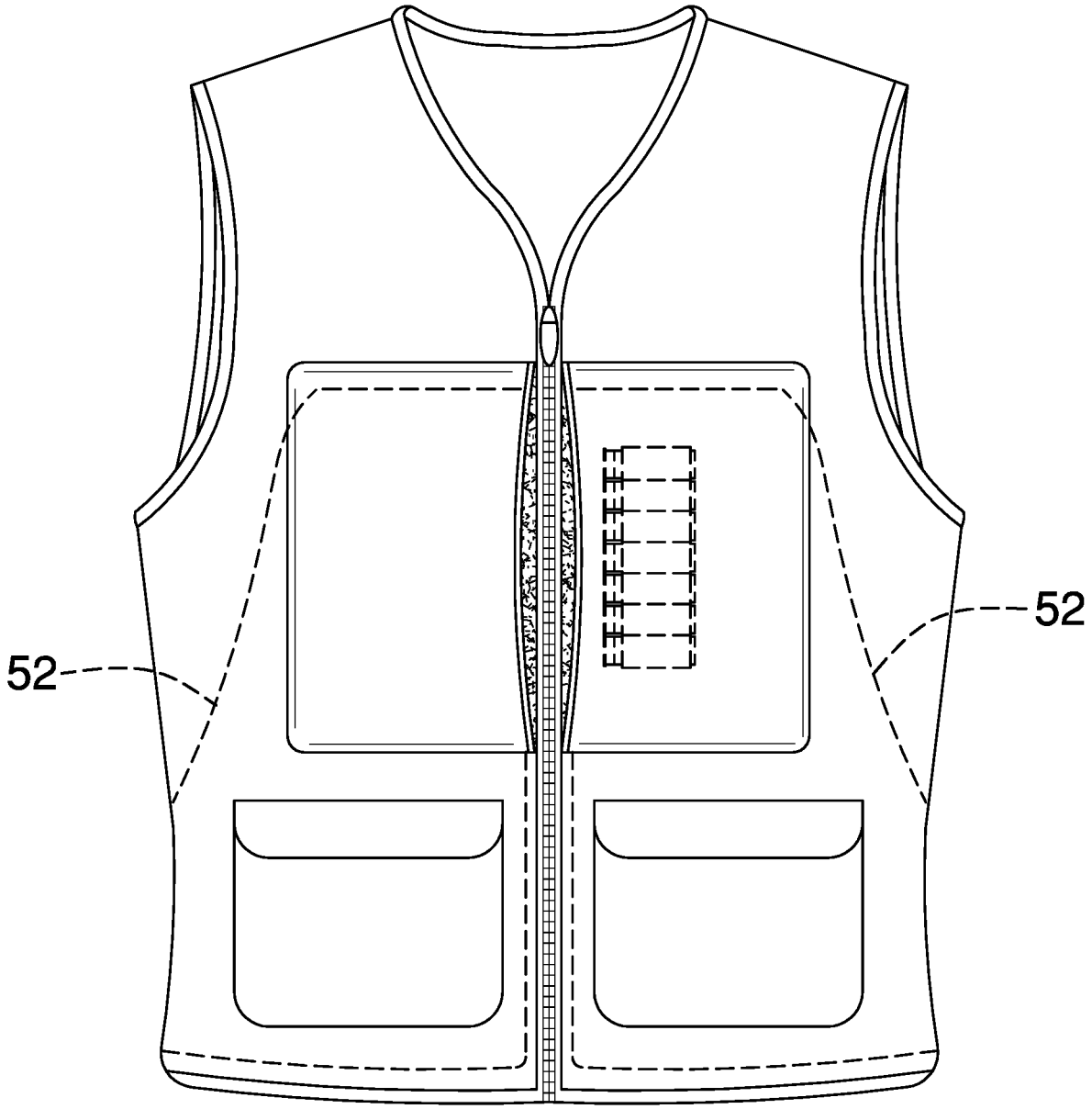
FIG. 4 is a front view of an embodiment of the disclosure.
Figure 5:
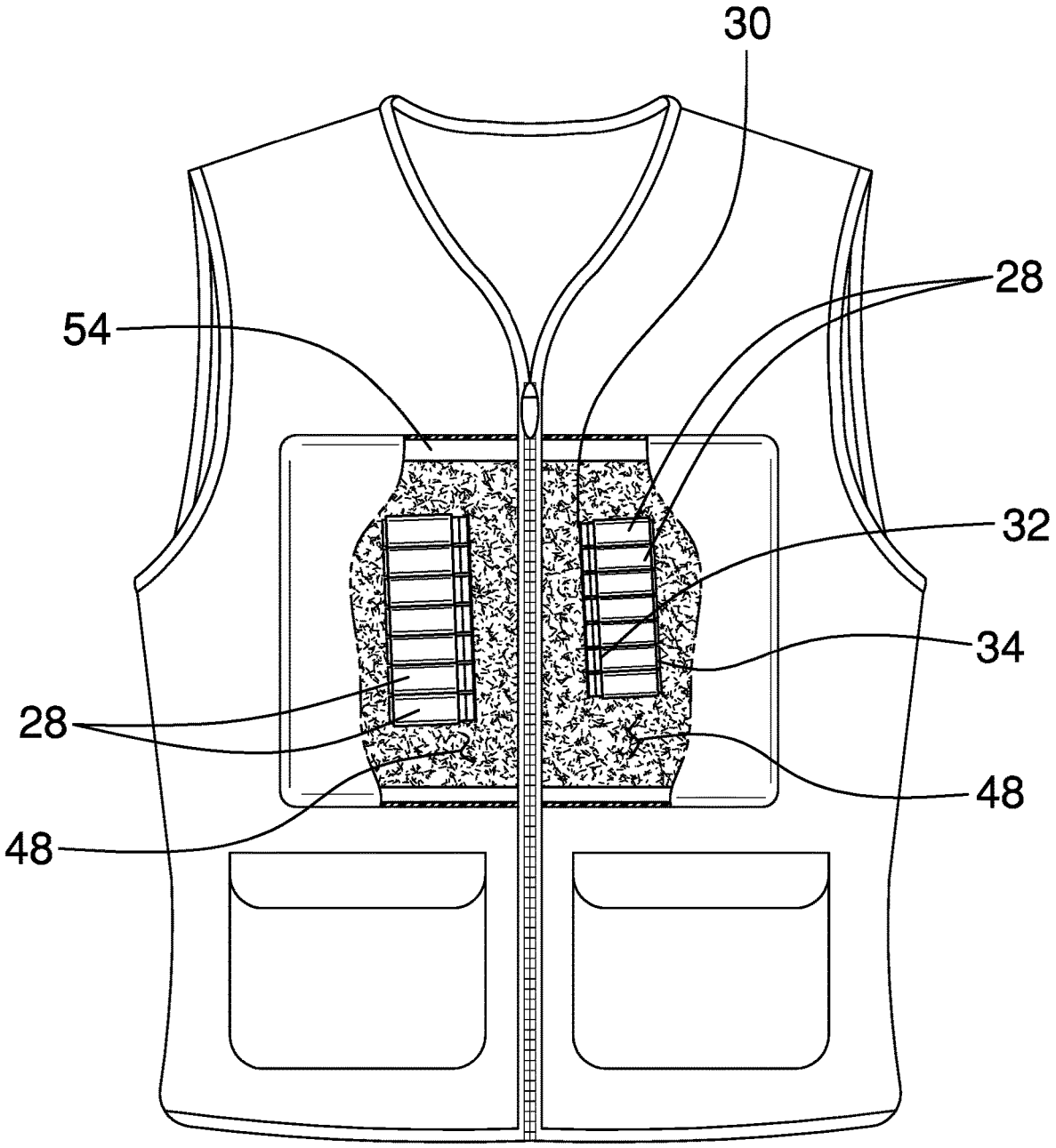
FIG. 5 is a front view of an embodiment of the disclosure.

The second mating member 48 is attached to the interior surface 54 of the pocket 52. As can be seen in FIGS. 3 and 5, the second mating member 48 may be much larger than the panel 12 to allow the user of the system 10 to selectively position the panel 12 where desired within the pocket 52. The panel 12 is thereafter releasably coupled to the interior surface 54 until such time that a user of the system 10 wishes to remove the panel 12 and access the ammunition.

In use, while most hunting jackets and vest jackets 50 include areas for holding ammunition, those areas are often positioned on the outside of the jacket and/or are fixed in position relative to the jacket. The system 10 allows a hunter to store a large number of panels with stored ammunition 30 thereon within the pockets 52 of the vest jacket 50 as those pockets 52 are typically quite large and include upper areas that tend to go unused. When a hunter wishes to reload, they may quickly pull the entire panel 12 out of the pocket 52 or remove one shell at a time which is easily locatable and graspable through an opening of the pocket 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An ammunition holding system for holding ammunition for easy access thereto, the ammunition holding system comprising:

a panel having a front side, a back side and a perimeter edge, the panel being comprised of a flexible material;

a plurality of receivers being positioned on the front side of the panel, each of the receivers being comprised to hold a single unit of ammunition to define a stored unit;

a coupler including a first mating member and a second mating member releasably coupled to each other, the first mating member being positioned on the back side of the panel;

an article of clothing configured to be worn on a torso of a person, the article of clothing including a pocket having an interior surface; and the second mating member being attached to the interior surface such that the panel is releasably couplable to the interior surface.

2. The ammunition holding system according to claim 1, wherein the panel has a length from a first lateral edge to a second lateral edge between 6.0 inches and 12.0 inches and height from a bottom edge to a top edge between 1.0 inches and 3.0 inches.

3. The ammunition holding system according to claim 1, wherein each of the receivers has an upper end and a lower end each being open such that the stored unit extends outwardly of the upper and lower ends.

4. The ammunition holding system according to claim 3, wherein the receivers are aligned laterally along the front side of the panel.

5. The ammunition holding system according to claim 1, wherein each of the receivers comprises a resiliently elastic material.

6. The ammunition holding system according to claim 5, wherein each of the receivers comprises an arcuate outer wall extending away from the front side and having a pair of ends attached to front side, wherein each the outer wall and an associated section of the front side define a tubular member for receiving the ammunition.

7. The ammunition holding system according to claim 1, wherein the coupler comprises a hook and loop coupler.

8. The ammunition holding system according to claim 1, wherein each of the receivers has an upper end and a lower end each being open such that the stored unit extends outwardly of the upper and lower ends.

9. The ammunition holding system according to claim 8, wherein the receivers are aligned laterally along the front side of the panel.

10. The ammunition holding system according to claim 9, wherein each of the receivers comprises a resiliently elastic material.

11. The ammunition holding system according to claim 10, wherein each of the receivers comprises an arcuate outer wall extending away from the front side and having a pair of ends attached to front side, wherein each the outer wall and an associated section of the front side define a tubular member for receiving the ammunition.

12. The ammunition holding system according to claim 11, wherein the coupler comprises a hook and loop coupler.

13. The ammunition holding system according to claim 1, wherein each of the receivers comprises a resiliently elastic material.

14. The ammunition holding system according to claim 11, wherein each of the receivers comprises an arcuate outer wall extending away from the front side and having a pair of ends attached to front side, wherein each the outer wall and an associated section of the front side define a tubular member for receiving the ammunition.

15. The ammunition holding system according to claim 1, wherein the coupler comprises a hook and loop coupler.

16. An ammunition holding system for holding ammunition for easy access thereto, the ammunition holding system comprising:

a panel having a front side, a back side and a perimeter edge, the panel being comprised of a flexible material, the panel having a length from a first lateral edge to a second lateral edge between 6.0 inches and 12.0 inches and height from a bottom edge to a top edge between 1.0 inches and 3.0 inches;

a plurality of receivers being positioned on the front side of the panel, each of the receivers being comprised to hold a single unit of ammunition to define a stored unit, each of the receivers having an upper end and a lower end each being open such that the stored unit extends outwardly of the upper and lower ends, the receivers being aligned laterally along the front side of the panel, each of the receivers comprising a resiliently elastic material, each of the receivers comprising an arcuate outer wall extending away from the front side and having a pair of ends attached to front side, wherein each the outer wall and an associated section of the front side define a tubular member for receiving the ammunition;

a coupler including a first mating member and a second mating member releasably coupled to each other, the first mating member being positioned on the back side of the panel, the coupler comprising a hook and loop coupler;

an article of clothing configured to be worn on a torso of a person, the article of clothing including a pocket having an interior surface; and the second mating member being attached to the interior surface such that the panel is releasably couplable to the interior surface.

* * * * *